United States Patent [19]

Gross

[11] Patent Number: 4,726,878

[45] Date of Patent: Feb. 23, 1988

[54] CHEMICAL MILLING METHOD FOR INTERIORS OF NARROW TUBES

[75] Inventor: Donald W. Gross, San Diego, Calif.

[73] Assignee: Chemtronics, El Cajon, Calif.

[21] Appl. No.: 939,181

[22] Filed: Dec. 8, 1986

[51] Int. Cl.[4] ..... C23F 1/00; C23F 1/02

[52] U.S. Cl. ..... 156/639; 156/661.1; 156/659.1

[58] Field of Search ..... 156/345, 639, 654, 664, 156/659.1, 661.1

[56] References Cited

U.S. PATENT DOCUMENTS

| | | | |
|---|---|---|---|
| 2,739,047 | 3/1956 | Sanz | 156/664 X |
| 2,883,275 | 4/1959 | Hirdler | 156/345 X |
| 4,588,474 | 5/1986 | Gross | 156/661.1 X |

*Primary Examiner*—Kenneth M. Schor
*Assistant Examiner*—Thi Dang
*Attorney, Agent, or Firm*—Frank D. Gilliam

[57] ABSTRACT

A method for etching patterns on the interior surface of narrow metal tubes. A thin tube having a narrow internal diameter is dipped into a maskant solution to a depth equal to the distance from the tube end etching is to be stopped. A thixotropic maskant having high edge thickness along the dipped edge is required. The shaft is removed from the maskant and dried. Plural dips to increase maskant thickness may be used, if desired. Both ends of the tube may be dipped to localize the area to be etched away from both ends. The tube is placed in an etching solution which is agitated and replenished as desired. After a suitable period, the tube is removed from the etchant, rinsed, dried and the maskant peeled away. A sharp, even, etched edge results, with a smooth fillet and no leaks of etchant through the maskant. The quality of the etch will be greatly increased where an iron-nickel-chromium alloy such as 718 Inconel is being etched by maintaining the metal ion ratio of the etchant at from about 50 to 60 g/l for the iron ion and from about 35 to 49 g/l for the nickel ion, with the grams per liter of the nickel ion always less than the iron ion.

5 Claims, 2 Drawing Figures

CHEMICAL MILLING METHOD FOR INTERIORS OF NARROW TUBES

BACKGROUND OF THE INVENTION

This invention relates in general to chemical etching of metals and, more specifically, to improvements in the etching of portions the interior walls of narrow metal tubes.

Chemical etching processes in which a pattern of etchant-resistant maskant is placed over a metal surface, the surface is immersed in an etching solution which dissolves the exposed metal to the desired depth, the surface is removed and rinsed and the maskant is removed have long been known. This has been found to be very effective in producing precise patterns and of removing excess metal to reduce the weight of structures, especially those used in aerospace products.

Weight saving is very important in aircraft to reduce the energy consumed in flight. Attempts have been made to chemically etch interior surfaces in aircraft engine shafts which require a high tolerance cylindrical exterior surface and greater strength near the ends, but less strength near the centers. Such tubular shafts have been dipped into a maskant (one or both ends) to leave a central area exposed. The tube is immersed in an etchant which etches the tube interior, significantly reducing weight. Unfortunately, this process has had a number of problems with very irregular edges on the etched area, poor fillets along the edges of the etched area and etch leaks through the maskant near the etched area.

Attempts have been made to control this problem by inserting a scribing tool into the tube and scribing a circular line through the maskant at the desired etch area edge. The maskant overlapping into the area to be etched is removed and etching is accomplished. While successful in overcoming the edge irregularity and poor fillet problems, this method is very difficult to accomplish with very narrow tubes and requires great skill in scribing the line and removing the excess maskant without damaging the remaining maskant.

With many metals, particularly with iron-nickel-chromium alloys, etching is especially difficult in the confines of a narrow tube, with uneven etching and channelling being likely to occur, producing a less than optimum etched surface. In aircraft engines or the like it is particularly important that clean etch lines with smooth fillets be produced to retain maximum tube strength together with maximum removal of unnecessary weight.

Thus, there is a continuing need for improvements in methods for etching away unnecessary tube wall thickness in specific areas within tubes intended for aerospace applications.

SUMMARY OF THE INVENTION

The above noted problems, and others, are overcome by the method of this invention which, basically, comprises the steps of dipping at least one end of the tube into a maskant to the desired etch line, using a thixotropic maskant which is carefully selected to produce high edge thickness, drying the maskant, placing the tube in an etchant with suitable agitation and replenishment, removing the tube after sufficient time to produce the desired etching, then rinsing and drying the tube and peeling off the maskant.

I have further found that the quality of the etch produced by the method can be further improved where the tube is formed from an iron-nickel-chromium alloy such as those sold under the "Inconel" trademark by the Huntington Alloy Products Division of the International Nickel Company by using an etchant having a metal ion ratio in which the iron ion is present in quantities of from about 50 to 60 g/l and the nickel ion is present in quantities of from about 35 to 49 g/l. It is important that the nickel ion grams per liter never exceed the iron ion ratio. During etching the nickel level will tend to increase and eventually exceed the iron level because the nickel is being dissolved at approximately three times the rate of the iron. Therefore, the ion concentrations must be monitored during etching and the iron ion concentration must be replenished as necessary.

BRIEF DESCRIPTION OF THE DRAWING

Details of the invention and of certain preferred embodiments thereof will be further understood upon reference to the drawing, wherein.

DETAILED DESCRIPTION OF THE INVENTION

Figure 1:
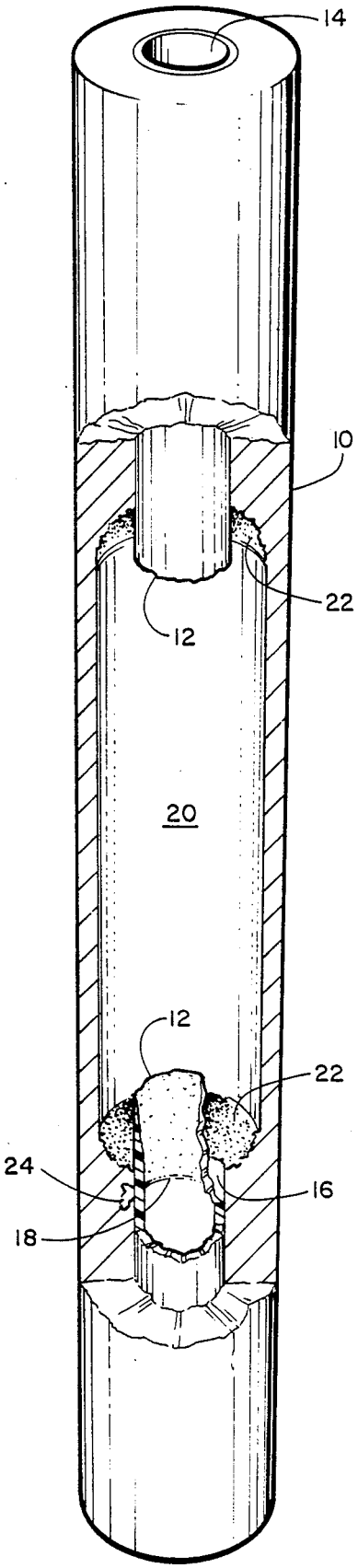
PRIOR ART FIGURE 1
FIG. 1 is an axial section through a tube which has been internally etched by the method of the prior art.

Referring now to FIG. 1, there is seen an axial section through a portion of a tube 10 etched according to the prior art. The original thickness of tube 10 is seen in the lower portion of the figure. The tube has been dipped into a conventional maskant one or more times to a depth sufficient to bring the maskant surface up to a line 12. The maskant is then dried, leaving a coating 14 having a substantially uniform thickness over the inside wall 16 of tube 10 except for the upper approximately 2 to 4 inches where the coating dries in a drastic taper 18 resulting in a very thin coating near line 12. When tube 10 is etched in a conventional etchant, the inside wall thickness is etched away at 20 to the desired thickness.

Apparently because of the very thin coating in taper 18, an unacceptable etch near line 12 results. Line 12 is irregular, resulting in an irregular line 12 and a rough, pitted fillet 22 which reduce tube strength due to stress concentrations in the irregularities. Also, etchant leaks through pinholes in coating 14 in the thin areas along taper 18, allowing undesired etched spots as seen at 24.

Also with many metals and conventional etchants, uneven etching and channelling may occur in the etched area 20. These further reduce the strength of the etched wall area, requiring that less metal be etched away overall to retain the necessary wall strength and resulting in a heavier final tube.

Figure 2:
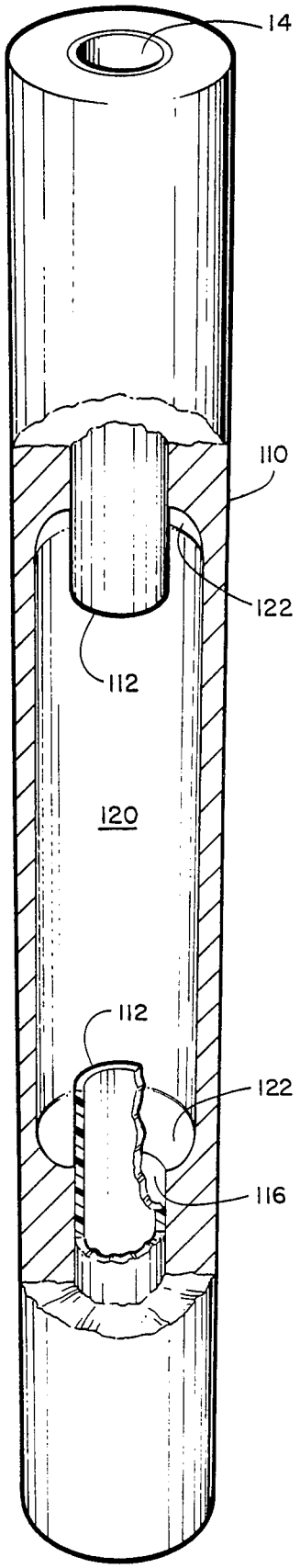
FIG. 2 is an axial section through a tube which has been internally etched by the method of this invention.

FIG. 2 shows an axial section through a tube etched in accordance with the method of this invention. Tube 110 is dipped into a maskant to line 112. The maskant is dried and the tube re-dipped one or more additional times to line 112, as desired. While the tube may be dipped any suitable number of times, I have obtained optimum results where the tube is dipped to exactly the same line 4 times, with at least partial drying of the maskant between dips.

The maskant must be one which produces a high edge thickness rather than the taper 18 as seen in FIG. 1. Thickness in the immediate vicinity of the edge should be about 0.015 inch for best results. Just which factors produce the high edge thickness characteristic is not fully understood. It is likely to be a combination of thixotropic agent, maskant viscosity, resin and rubber content and similar factors. Also, since many maskant manufacturers tend to maintain their exact formulations as trade secrets, it is difficult to determine which factors produce an effective maskant for my purpose.

The preferred maskants are mixtures of synthetic rubber, synthetic resin, filler, a thixotropic agent and solvent. Typically, the thixotropic characteristic can be obtained by the carefully controlled reaction of a small portion of a polyamide resin with an alkyd resin vehicle.

A simple test may be used to determine whether a specific maskant will be effective in my method. A sheet of metal is dipped into the maskant to a marked line and dried, then re-dipped to the line and dried any additional times desired. The maskant coating is then scribed along a line perpendicular to the line and the maskant on one side of the scribed line is peeled away. The maskant coating along the scribed line is examined. If the thickness of the maskant about 0.25 inch from the dip line is at least about 80% of the thickness of the maskant about 6 inches from the line, the maskant should be satisfactory. I have obtained outstanding results with a maskant available from adcoat Incorporated under the designation "8J-100". That maskant easily passes the above test. It appears to be a high resin, high rubber maskant and has a viscosity of about 36 to 42 seconds through a No. 5 Zahn cup.

Once the desired maskant coating 114 is formed the tube is placed in an etchant bath for the required time, with agitation and replenishment as desired. Typically, the tube may be agitated in an apparatus of the sort described in Brimm's U.S. Pat. No. 4,137,118 or etchant may be pumped through the tube.

Any etching solution suitable for the metal of which tube 110 is fabricated may be used. Typical etching solutions are described in U.S. Pat. Nos. 3,039,909 (De Long), 3,108,919 (Snyder et al.) and 3,745,079 (Cowles et al.).

An inside wall 116 is etched away above line 112, the desired width is reached in etched area 120. As etching progresses, coating 114 at line 112 is undercut uniformly, forming a smooth fillet 122. There are no etchant leaks through pinholes, since pinholes are absent from the uniform thickness coating 114. Since the edge of coating 114 at line 112 is smooth and uniform, a smooth and uniform fillet 122 is formed. Upon completion of etching the tube is removed from the etchant and rinsed, with water or any other suitable liquid, to remove residual etchant. The maskant then may be easily peeled from the tube surface.

As a further feature of my invention, I have found that a very smooth and uniform etched wall 120, with maximum weight removal consistant with wall strength, can be obtained by carefully controlling the metal ion content of the etchant when tube 110 is formed from an iron-nickel chromium alloy. Excellent results are obtained with 718 Inconel, an iron-chromium-nickel alloy from International Nickel which is highly desirable for aircraft engine applications. This alloy is, therefore, preferred for use with the method of this invention. I have found that very uniform etching with substantially no channelling can be obtained if the metal ion ratio is kept in the following ranges; Iron ion, about 50 to 60 g/l and Nickel ion, about 35 to 49 g/l, with the nickel quantity in grams per liter always less than the iron ion.

Details of various etching parameters, such as concentration of active agent, temperature, rate of agitation, etc. will vary depending on the tube material, sizes, etc. One skilled in the art may select these process variables from any variety of handbooks, such as the Metals Handbook, available from the American Society for Metals, Metals Park, Ohio.

In many cases, both ends of a tube will be masked and only a center portion will be etched. For example, a 58 inch tube having an outside diameter of two inches and an inside diameter of three quarters inch may be easily masked to etch a 27 inch length near the center of the tube.

Other variations, ramifications and applications of this invention will occur to those skilled in the art upon reading this specification. Those are intended to be included within the scope of this invention, as defined in the appended claims.

What is claimed is:

1. A method for chemically etching away metal from the interior wall of a narrow metal tube at a location spaced from the end of the tube which comprises:

dipping a narrow metal tube at least once into a thixotropic maskant solution to a depth equal to the distance from the tube end to where etching is to be stopped to provide a deposited layer of maskant having an edge adjacent the point where etching is to be stopped;

said maskant being selected to provide relatively high edge thickness along the maskant edge, the maskant thickness near said edge being at least about 80% of the maskant thickness 6 or more inches from said edge;

drying said maskant after each dip;

placing said tube in an etchant solution for a period sufficient to permit said etchant to etch the unmasked tube interior wall to the desire extent;

rinsing said tube interior to remove residual etchant solution; and peeling away said maskant;

whereby a sharp, even etched edge with a smooth fillet is produced at said maskant edge, and there is no damage from etchant leaking through said maskant there is.

2. The method according to claim 1 wherein said tube is dipped into said maskant to the same depth and dried up to four times.

3. The method according to claim 1 wherein both ends of said tube are dipped in said maskant so that an area of the tube interior wall spaced from both tube ends is etched.

4. The method according to claim 1 wherein the metal of said tube is an iron-nickel-chromium alloy, and the metal ion ratio of said etchant is maintained at from about 50 to 60 grams per liter for the iron ion and from about 35 to 49 grams per liter for the nickel ion, with the grams per liter of the nickel ion maintained at all times less than for the iron ion.

5. The method according to claim 1 wherein the thickness of said dry maskant in the immediate vicinity of the edge is about 0.015 inch.

* * * * *